US011738573B2

(12) United States Patent
Matsuba

(10) Patent No.: US 11,738,573 B2
(45) Date of Patent: Aug. 29, 2023

(54) INK JET PRINTER

(71) Applicant: Roland DG Corporation, Hamamatsu (JP)

(72) Inventor: Kikuo Matsuba, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/496,807

(22) Filed: Oct. 8, 2021

(65) Prior Publication Data

US 2023/0111746 A1 Apr. 13, 2023

(51) Int. Cl.
*B41J 11/00* (2006.01)
*B41J 2/01* (2006.01)

(52) U.S. Cl.
CPC ..... *B41J 11/007* (2013.01); *B41J 2/01* (2013.01)

(58) Field of Classification Search
CPC . B41J 15/04; B41J 15/16; B41J 15/165; B41J 11/007; B65H 23/16; B65H 16/06; B65H 2301/522; B65B 9/2028
See application file for complete search history.

(56) References Cited

U.S. PATENT DOCUMENTS 5,057,861 A * 10/1991 Maeda ..... G03B 27/32 355/402
5,911,382 A * 6/1999 Wilson ..... B65H 23/16 101/228
6,766,844 B1 * 7/2004 Watkins ..... B32B 43/006 156/760
7,397,487 B2 * 7/2008 Fukui ..... B41J 11/007 347/264
2008/0128545 A1 * 6/2008 Midorikawa ..... B65H 16/06 270/1.01
2011/0023423 A1 * 2/2011 Iwasaki ..... B65B 57/00 53/510
2011/0242245 A1 * 10/2011 Okazaki ..... B41J 15/165 242/419.7
2012/0042799 A1 * 2/2012 Kojima ..... B41J 15/04 101/474

(Continued)

FOREIGN PATENT DOCUMENTS

JP 2004-188655 A 7/2004
JP 2008-132628 A 6/2008

(Continued)

*Primary Examiner* — John Zimmermann
(74) *Attorney, Agent, or Firm* — KEATING & BENNETT, LLP

(57) ABSTRACT

A printer includes a platen to support a medium, a conveyor to convey the medium supported by the platen from an upstream side toward a downstream side in conveyance directions, a tension bar, and a floating bar. The tension bar is downstream of the platen in the conveyance directions and positioned such that a lower surface of the medium conveyed from the platen to the downstream side in the conveyance directions contacts the tension bar. The floating bar is downstream of the platen in the conveyance directions and upstream of the tension bar in the conveyance directions and positioned such that an upper surface of the medium located between the platen and the tension bar contacts the floating bar, and has a center axis freely movable by a predetermined degree.

6 Claims, 4 Drawing Sheets

(56) References Cited

U.S. PATENT DOCUMENTS

| | | | | |
|---|---|---|---|---|
| 2015/0077494 | A1* | 3/2015 | Obata | B41J 11/007 198/635 |
| 2017/0368844 | A1* | 12/2017 | Milini | B41J 11/0015 |
| 2018/0215179 | A1* | 8/2018 | Akahane | B65H 23/1806 |

FOREIGN PATENT DOCUMENTS

| | | | |
|---|---|---|---|
| JP | 2009-173443 | A | 8/2009 |
| JP | 2010-046873 | A | 3/2010 |
| JP | 2014-024643 | A | 2/2014 |
| JP | 2019-142128 | A | 8/2019 |

* cited by examiner

INK JET PRINTER

BACKGROUND OF THE INVENTION

1. Field of the Invention

The present teaching relates to an ink jet printer.

2. Description of the Related Art

JP 2008-132628A, for example, discloses an ink jet printer that discharges ink onto a sheet-like medium for printing. The ink jet printer includes a platen, and a driving roller and a pinching roller that vertically sandwich a medium. When the driving roller rotates, the medium on the platen is thereby conveyed from an upstream side toward a downstream side in conveyance directions.

In the ink jet printer, ink is discharged onto the medium on the platen, and printing is performed. In this printing, to assure printing quality, the medium on the platen is preferably flat. In view of this, the driving roller and the pinching roller are disposed upstream of the platen, for example, and a tension bar is disposed downstream of the platen. A movable tension bar is disposed downstream of the tension bar. The movable tension bar applies a tension to the medium. Consequently, the medium on the platen can be made flat.

Media include relatively thin media. In conveying a thin medium in the conveyance directions, a center portion of the medium in a lateral direction orthogonal to the conveyance directions in a plan view is loosened. Consequently, the thin medium might float up from the platen in some cases. This floating of the medium leads to degradation of printing quality. The floating of the medium is more likely to occur as the thickness of the medium decreases. In addition, the floating of the medium is likely to occur in a configuration in which only both end portions of the medium in the lateral direction are pinched by the driving roller and the pinching roller. The floating of the medium is reduced by strictly adjusting parallelism between the driving roller and the tension bar, but it is difficult to suppress the occurrence of floating of the medium in some printing environments including humidity and temperature.

SUMMARY OF THE INVENTION

Preferred embodiments of the present invention provide ink jet printers capable of suppressing floating of a medium from a platen.

An ink jet printer according to a preferred embodiment of the present teaching includes a platen to support a medium, a conveyor, a tension bar, and a floating bar. The conveyor conveys the medium supported by the platen from an upstream side toward a downstream side in the conveyance direction. The tension bar is downstream of the platen in the conveyance directions and positioned such that a lower surface of the medium conveyed from the platen to the downstream side in the conveyance directions contacts the tension bar. The floating bar is downstream of the platen in the conveyance directions and upstream of the tension bar in the conveyance directions such that an upper surface of the medium located between the platen and the tension bar contacts the floating bar, the floating bar having a center axis that is freely movable by a predetermined degree.

In the ink jet printer, the floating bar is positioned on the medium located between the platen and the tension bar. At this time, the floating bar pushes the medium downward while freely moving in accordance with a tension exerted on the medium. Thus, the medium can be stretched by the floating bar so that floating of the medium from the platen can be reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Ink jet printers according to preferred embodiments of the present teaching will be described with reference to the drawings. The preferred embodiments described herein is, of course, not intended to particularly limit the present teaching.

Figure 1:
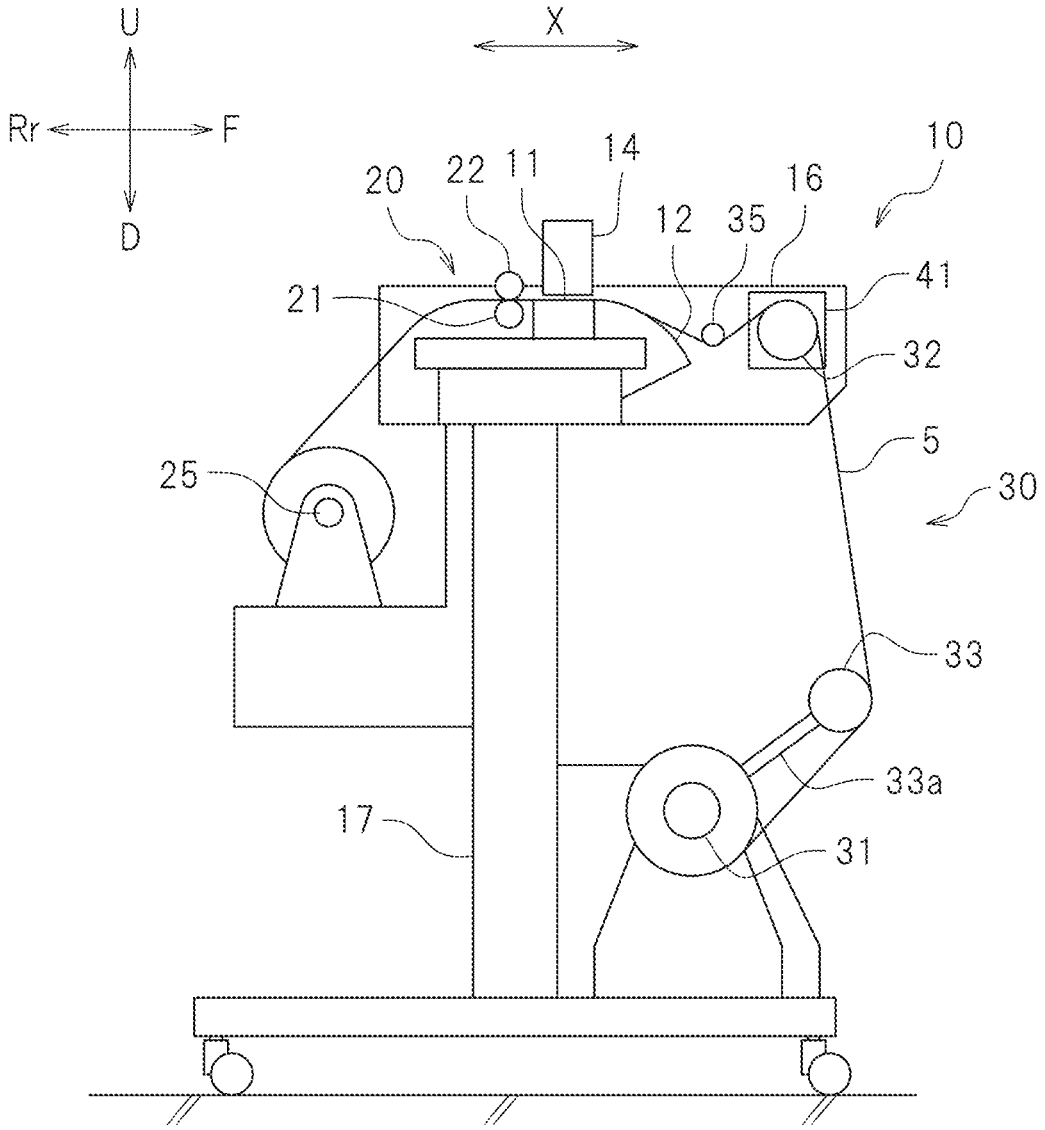
FIG. 1 is a side view schematically illustrating a printer according to a preferred embodiment of the present teaching.

FIG. 1 is a side view schematically illustrating an ink jet printer (hereinafter referred to as a printer) 10 according to a preferred embodiment of the present teaching. In the drawings, characters F, Rr, L, R, U, and D represent front, rear, left, right, up, and down, respectively, of the printer 10. Characters Y and X represent scanning directions and conveyance directions, respectively. For example, the scanning directions Y are left-right directions. The conveyance directions X intersect the scanning directions Y in plan view, and are orthogonal to the scanning directions Y in this preferred embodiment. The conveyance directions X are front-rear directions, for example. In this preferred embodiment, the rear side in the conveyance directions X is defined as an upstream side in this preferred embodiment. The front side in the conveyance directions X is defined as a downstream side. These directions are merely directions defined for convenience of description, and do not limit the state of installation of the printer 10.

The printer 10 is, for example, a large-size ink jet printer. As illustrated in FIG. 1, the printer 10 includes a platen 11, an apron 12, and an ink head 14. The platen 11 supports a medium 5. The medium 5 is, for example, a recording sheet. The medium 5 is not limited to a specific type. In this preferred embodiment, the medium 5 is placed on the upper surface of the platen 11. The upper surface of the platen 11 expands in the scanning directions Y and the conveyance directions X. Printing is performed on the medium 5 on the platen 11.

The apron 12 is disposed downstream of the platen 11 in the conveyance directions X. The apron 12 has an arc shape in cross section. The apron 12 is curved downward as the distance from the platen 11 increases. In this preferred embodiment, the platen 11 and the apron 12 are supported by a pair of left and right side frames 16. FIG. 1 shows the right side frame 16, and does not show the left side frame 16. The pair of left and right side frames 16 is disposed at both ends of the platen 11 and the apron 12 in the scanning directions Y. In this preferred embodiment, a body frame 17 is disposed between the pair of left and right side frames 16. The pair of left and right side frames 16 extends from the left and right ends of the body frame 17 forward, that is, toward the downstream side in the conveyance directions X in this preferred embodiment.

The ink head 14 is configured to discharge ink onto the medium 5 supported by the platen 11. In this preferred embodiment, the ink head 14 is mounted on an unillustrated carriage. The ink head 14 is movable in the scanning directions Y together with the carriage.

The printer 10 includes a conveyance mechanism 20. The conveyance mechanism 20 conveys the medium 5 supported by the platen 11 from the upstream side toward the downstream side in the conveyance directions X (from the rear toward the front in this preferred embodiment). The conveyance mechanism 20 is disposed upstream of the platen 11 in the conveyance directions X. The conveyance mechanism 20 is not limited to a specific configuration.

Figure 2:
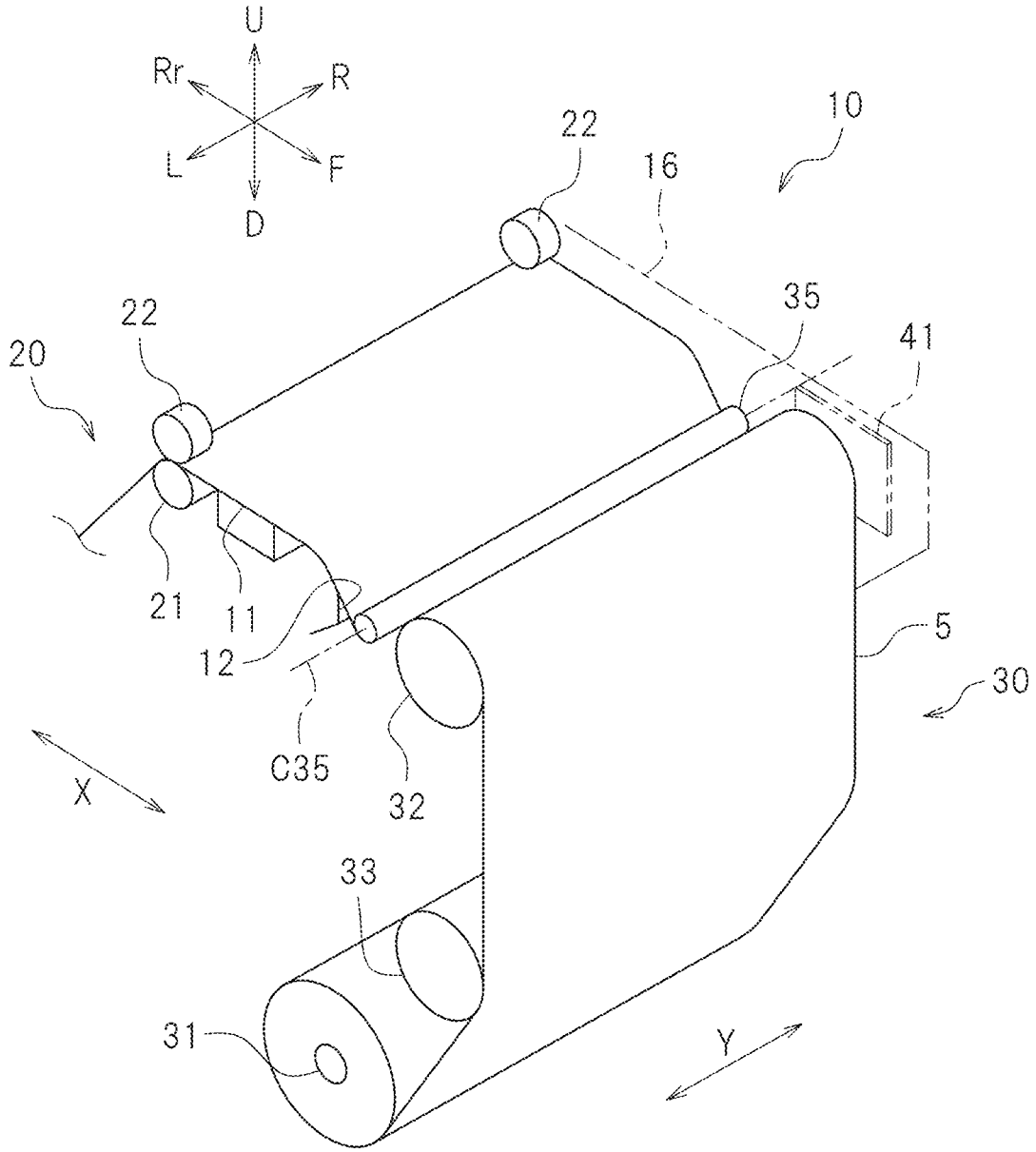
FIG. 2 is a perspective view illustrating the printer in a state where a medium is conveyed.

In this preferred embodiment, the conveyance mechanism 20 includes driving rollers 21 and pinching rollers 22. The driving rollers 21 and the pinching rollers 22 are disposed upstream of the platen 11 in the conveyance directions X. FIG. 2 is a perspective view of the printer 10 illustrating a state where the medium 5 is conveyed. As illustrated in FIG. 2, the driving rollers 21 and the pinching rollers 22 are located to sandwich both ends of the medium 5 in the lateral direction (the scanning directions Y in this preferred embodiment). The right driving roller 21 is not shown in FIG. 2. The pinching rollers 22 are disposed above the driving rollers 21. The driving rollers 21 and the pinching rollers 22 are configured to vertically sandwich both lateral ends of the medium 5. The pinching rollers 22 may be disposed at locations except for the both lateral ends of the medium 5, as necessary.

Although not shown, a driving motor is connected to the driving rollers 21. When the driving motor is driven, the driving rollers 21 are caused to rotate. Accordingly, the medium 5 sandwiched between the driving rollers 21 and the pinching rollers 22 is conveyed from the upstream side toward the downstream side in the conveyance directions X.

In this preferred embodiment, as illustrated in FIG. 1, a supply bar 25 is disposed upstream of the platen 11. The supply bar 25 extends in the scanning directions Y. The medium 5 is rolled around the peripheral surface of the supply bar 25. The medium 5 rolled around the supply bar 25 is supplied to the platen 11 by the conveyance mechanism 20.

The printer 10 includes a winding mechanism 30. The winding mechanism 30 is disposed downstream of the platen 11 in the conveyance directions X. The winding mechanism 30 includes a winding bar 31, a tension bar 32, and a movable tension bar 33.

The winding bar 31 extends in the scanning directions Y. The winding bar 31 is configured to wind the printed medium 5. The tension bar 32 extends in the scanning directions Y and is supported by the pair of left and right side frames 16. The tension bar 32 is configured to hold the medium 5 on the platen 11 in a flat state. The tension bar 32 is disposed above the winding bar 31. The upper end of the tension bar 32 is disposed at the same height as the upper surface of the platen 11 or at a position higher than the upper surface of the platen 11.

The movable tension bar 33 is configured to apply a tension to the medium 5. The movable tension bar 33 is disposed between the tension bar 32 and the winding bar 31. The movable tension bar 33 is disposed downstream of the tension bar 32. The movable tension bar 33 extends in the scanning directions Y.

The movable tension bar 33 is capable of swinging about the winding bar 31. In this preferred embodiment, the movable tension bar 33 is attached to the winding bar 31 with an arm 33*a* interposed therebetween. The arm 33*a* is integrated with the movable tension bar 33. The arm 33*a* is configured to swing about the rotation axis of the winding bar 31. The movable tension bar 33 is attached to be movable about the rotation axis of the winding bar 31 by swinging of the arm 33*a*. The movable tension bar 33 may be configured to be pivotable itself.

For example, a tension is applied to the medium 5 by forward and downward movement of the movable tension bar 33 by its own weight. The application of the tension to the medium 5 by the movable tension bar 33 stabilizes winding of the medium 5 by the winding bar 31. The tension applied to the medium 5 by the movable tension bar 33 is made uniform on the platen 11. Thus, the tension bar 32 functions as a bar that pulls the medium 5 between the driving rollers 21 and the movable tension bar 33.

As illustrated in FIG. 1, the printer 10 includes a floating bar 35. The floating bar 35 is disposed downstream of the platen 11 in the conveyance directions X and upstream of the tension bar 32 in the conveyance directions X. In other words, the floating bar 35 is disposed between the platen 11 and the tension bar 32. The floating bar 35 contacts a portion of the medium 5 located between the platen 11 and the tension bar 32, that is, the upper surface (e.g., a printing surface) of a portion of the medium 5 floating without contacting the platen 11. The outer peripheral surface of the floating bar 35 is brought into contact with the upper surface of the medium 5 by a predetermined weight (e.g., the weight of the floating bar 35).

The floating bar 35 contacts the medium 5 across the entire width thereof. The floating bar 35 is configured to be pushed against the upper surface of the medium 5 by the weight of the floating bar 35. The floating bar 35 is rotatable with respect to the medium 5. In this preferred embodiment, the floating bar 35 does not have a biasing mechanism for pushing the floating bar 35 against the medium 5.

Although the configuration will be specifically described later, the floating bar 35 is attached to be swingable (i.e., rotatable) about the rotation axis of the tension bar 32. The floating bar 35 is configured such that the rotation axis (i.e., the center axis) of the floating bar 35 is freely movable by a predetermined degree.

The medium 5 is pushed slightly downward by bringing the floating bar 35 into contact with the upper surface of the medium 5 floating between the platen 11 and the tension bar 32. Accordingly, a tension of the medium 5 in the lateral direction is levelled as described later. Consequently, floating of the medium 5 from the platen 11 is reduced or prevented. The downward pushing of the medium 5 by the floating bar 35 causes the medium 5 to be pushed against the upper surface of the platen 11.

In FIG. 2, the lengths of the winding bar 31, the tension bar 32, the movable tension bar 33, and the floating bar 35 in the scanning directions Y are equal to the length of the medium 5 in the lateral direction (the scanning directions Y in this preferred embodiment). The length of the medium 5 in the lateral direction is also the length of the platen 11 in the lateral direction. However, in practice, the lengths of the winding bar 31, the tension bar 32, the movable tension bar 33, and the floating bar 35 in the scanning directions Y may be longer than the length of the medium 5 in the lateral direction depending on the size of the medium 5.

In this preferred embodiment, the medium 5 conveyed by the conveyance mechanism 20 to the downstream side of the conveyance directions X is guided from the platen 11 to the outer peripheral surface of the tension bar 32 with floating of the medium 5 adjusted by the floating bar 35. Thereafter, the movable tension bar 33 is brought into contact with the surface of the medium 5 opposite to the printing surface, that is, with the lower surface of the medium 5 on the platen 11. Subsequently, the medium 5 is wound around the outer peripheral surface of the winding bar 31.

Figure 3:
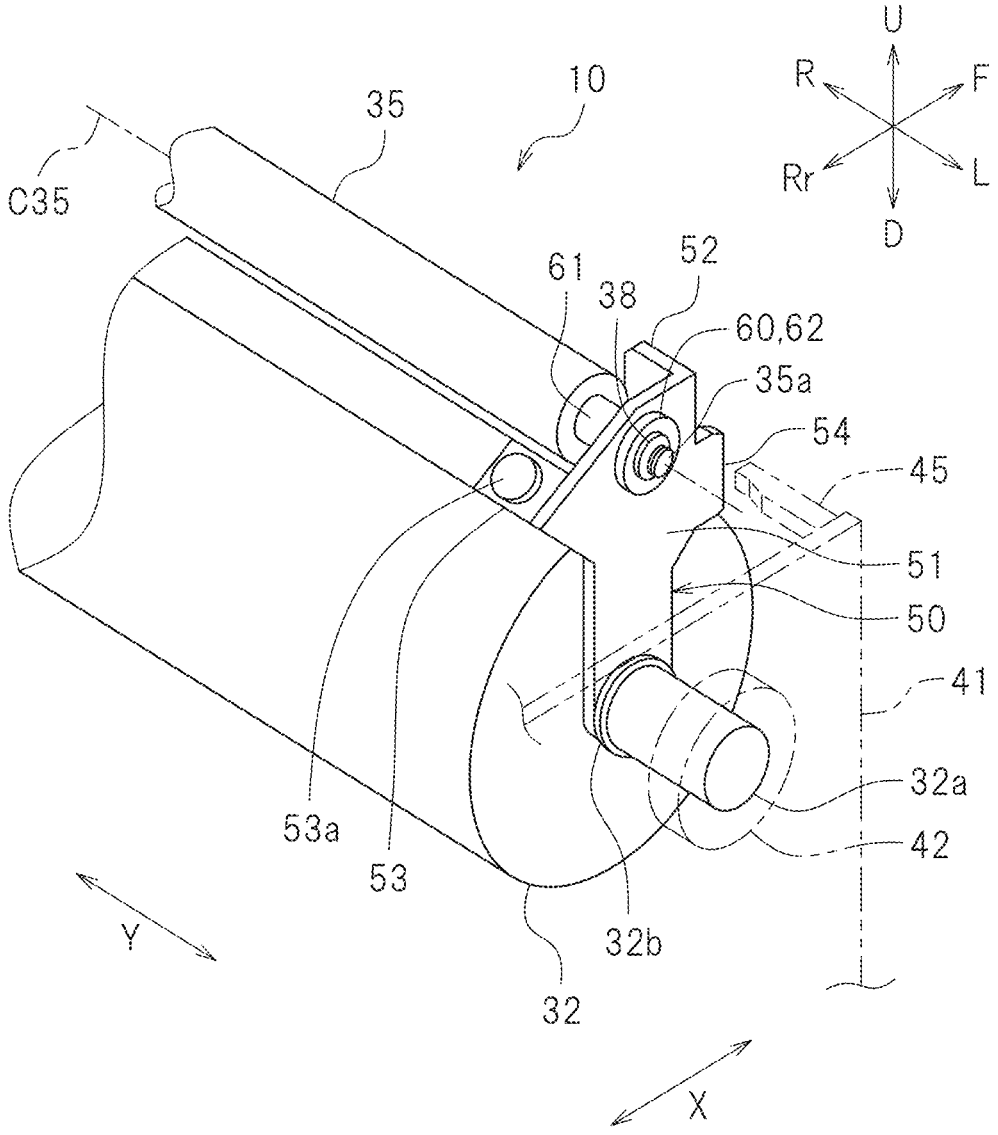
FIG. 3 is a perspective view illustrating an attachment structure of a tension bar and a floating bar.
Figure 4:
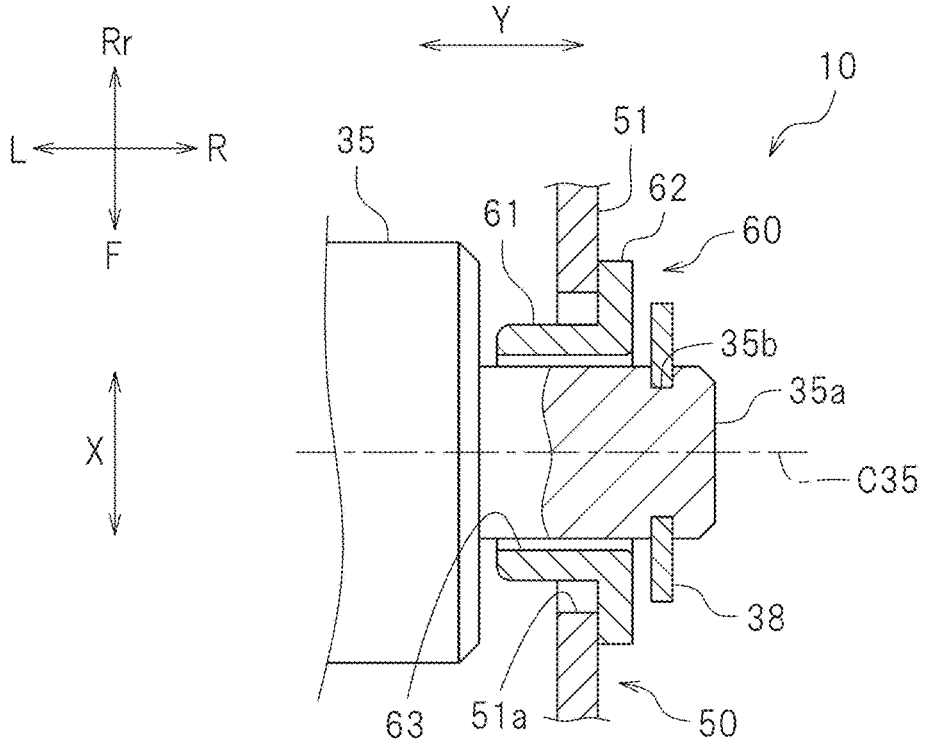
FIG. 4 is a cross-sectional view illustrating a center axis member of the floating bar, a bracket, and a bush.
Figure 5:
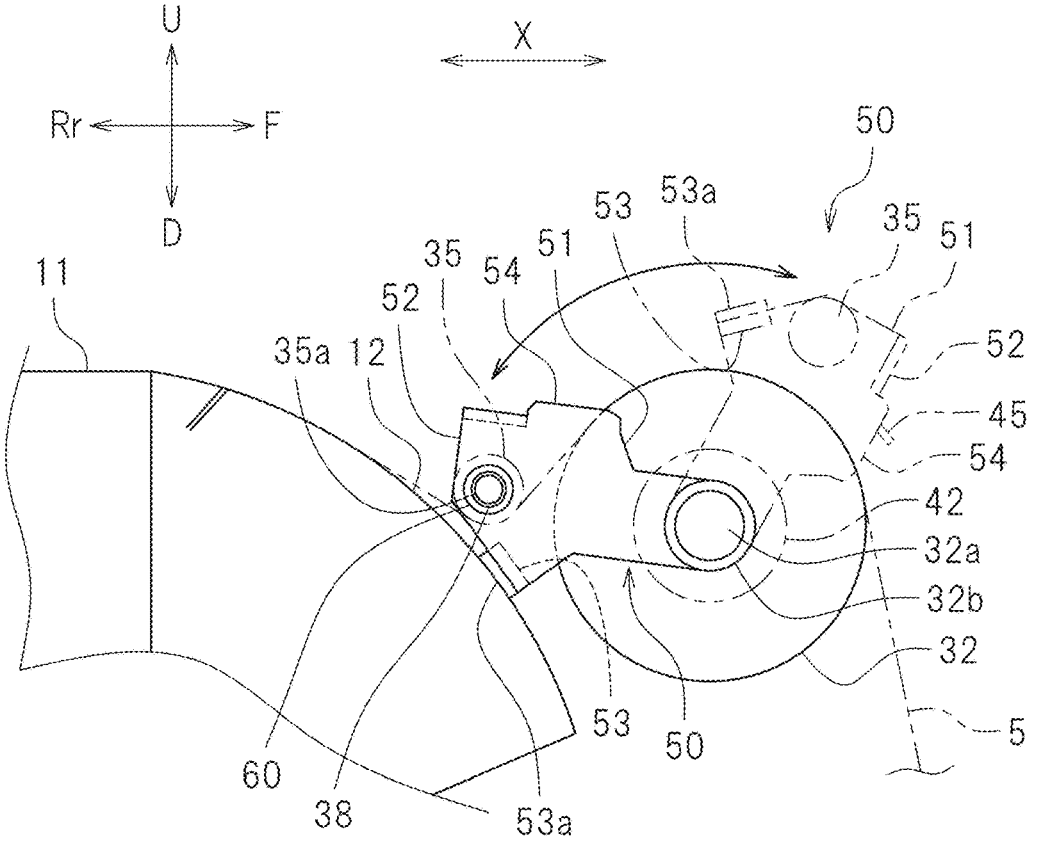
FIG. 5 is an enlarged side view illustrating a portion of the printer in order to describe functions of the floating bar.

Next, a structure in which the floating bar 35 is attached to the tension bar 32 will be described in detail. FIG. 3 is a perspective view illustrating an attachment structure of the tension bar 32 and the floating bar 35. FIG. 4 is a cross-sectional view illustrating a center axis member 35*a* of the floating bar 35, a bracket 50, and a bush 60. FIG. 5 is an enlarged side view illustrating a portion of the printer 10 in order to describe functions of the floating bar 35. FIG. 5 does not show the side frames 16 and support members 41. FIGS. 3 and 4 show only a right end portion of the floating bar 35 or the tension bar 32 and a peripheral configuration of the right end portion, and does not show a left end portion of the floating bar 35 or the tension bar 32 and a peripheral portion of the left end portion. In this preferred embodiment, the left end portion of the floating bar 35 or the tension bar 32 and the peripheral portion of the left end portion correspond to the right end portion of the floating bar 35 or the tension bar 32 and the peripheral configuration of the right end portion, and thus, the left end portion of the floating bar 35 or the tension bar 32 and the peripheral configuration of the left end portion are not shown in detail.

In this preferred embodiment, the pair of left and right side frames 16 is disposed at the left and right ends of the tension bar 32. The tension bar 32 is bridged across the pair of left and right side frames 16. The tension bar 32 is rotatably supported on the pair of left and right side frames 16. Specifically, the pair of left and right support members 41 (see FIG. 3) is disposed on the surfaces of the pair of left and right side frames 16 toward the tension bar 32. The support members 41 are formed by bending metal plates and each have a plate shape. As illustrated in FIG. 3, the support members 41 include cylindrical bearings 42. Stoppers 45 projecting inward in the scanning directions Y are provided on the downstream end portions (front end portions in this preferred embodiment) of the support members 41 in the conveyance directions X. The stoppers 45 are formed by bending.

The tension bar 32 includes a center axis member 32*a* projecting from left and right end portions of the tension bar 32 in the scanning directions Y. The center axis member 32*a* is tightly inserted in the bearing 42. In the manner described above, the tension bar 32 is rotatably supported on the pair of left and right side frames 16 with the support members 41 interposed therebetween.

In this preferred embodiment, the pair of left and right support members 41 is provided with a pair of left and right brackets 50. The brackets 50 are rotatably attached to the support members 41. The floating bar 35 is bridged over the pair of left and right brackets 50. The floating bar 35 is rotatably supported on the brackets 50.

The brackets 50 are formed by bending plate-shaped members (e.g., metal plate members). The brackets 50 are not limited to a specific configuration. In this preferred embodiment, as illustrated in FIG. 3, each of the brackets 50 includes a body portion 51, a projecting portion 52, an extending portion 53, and a restricting portion 54. The body portion 51 is supported by the tension bar 32. The body portion 51 has a through hole (not shown) in which the center axis member 32*a* of the tension bar 32 is inserted. In this preferred embodiment, two grooves (not shown) extending along the circumferential direction are provided in the outer peripheral surface of the center axis member 32*a* of the tension bar 32. The restricting members 32*b* (see FIG. 3) are individually inserted in the two grooves. The brackets 50 are to be sandwiched by the two restricting members 32*b*, and supported to be swingable about the center axis member 32*a* of the tension bar 32.

In this preferred embodiment, the floating bar 35 includes the center axis members 35*a* projecting from the left and right end portions of the floating bar 35 in the scanning directions Y. The center axis members 35*a* integrally project from the left and right end portions of the floating bar 35 toward the outside in the axial direction. As illustrated in FIG. 4, an insertion hole 51*a* in which the center axis member 35*a* is inserted extends through the body portion 51 of the bracket 50. As illustrated in FIG. 3, the projecting portion 52 is provided in a portion of the bracket 50 located at an outer side of the tension bar 32 relative to the body portion 51 when seen from an end of the tension bar 32 (e.g., in a right side view) and downstream of the floating bar 35 in the conveyance directions X. The projecting portion 52 projects toward the outside of the outer peripheral surface of the tension bar 32 (i.e., the outer peripheral surface of the floating bar 35) from the downstream end of the body portion 51 in the conveyance directions X. The projecting portion 52 projects along the tension bar 32. The projecting portion 52 is formed by bending.

The extending portion 53 is provided in a portion of the bracket 50 located at an outer side of the tension bar 32 relative to the body portion 51 when seen from an end of the tension bar 32 (e.g., in the right side view) and upstream of the floating bar 35 in the conveyance directions X. The extending portion 53 projects toward the outside of the outer peripheral surface of the tension bar 32 (i.e., the outer peripheral surface of the floating bar 35) from the upstream end of the body portion 51 in the conveyance directions X. The extending portion 53 projects along the tension bar 32. The extending portion 53 is formed by bending.

The body portion 51 of the bracket 50 extends along the radial direction of the tension bar 32. The floating bar 35 is swingably supported on the front end of the bracket 50 in the extension directions of the tension bar 32. The brackets 50 are configured to restrict a swing of the floating bar 35 toward the medium 5 by contact of the extending portions 53 of the brackets 50 (specifically cushioning members 53*a* described later) with the apron 12. The brackets 50 restrict a swing of the floating bar 35 in a direction away from the medium 5 by contact of the restricting portions 54 of the brackets 50 with the stoppers 45 provided on the support members 41.

In this preferred embodiment, as illustrated in FIG. 4, the bush 60 is inserted in the center axis member 35*a* of the floating bar 35. The bush 60 is made of resin. The bush 60 includes a cylindrical portion 61 extending along the center axis member 35*a*, and a flange portion 62 extending radially outward from an end of the cylindrical portion 61. The cylindrical portion 61 has an inner hole 63. The center axis member 35*a* of the tension bar 32 is inserted in the inner hole 63. The bush 60 is disposed to allow the cylindrical portion 61 to be inserted in the insertion hole 51*a* of the bracket 50 such that the flange portion 62 is located at the opposite side to the floating bar 35 with respect to the bracket 50.

In this preferred embodiment, a groove 35*b* extends along the circumferential direction in a portion of the center axis member 35*a* projecting from the bush 60. A retaining member 38 including, for example, a clip is inserted in the groove 35*b*. With the configuration described above, the floating bar 35 is supported to be rotatable with respect to the brackets 50.

In this preferred embodiment, a predetermined gap is provided between the inner hole 63 of the bush 60 and the center axis member 35*a* of the floating bar 35. In addition, a predetermined gap is also provided between the cylindrical portion 61 of the bush 60 and the insertion hole 51*a* of the bracket 50. In this manner, the floating bar 35 is freely fitted onto the brackets 50. In the floating bar 35, a center axis C35 of the floating bar 35 freely moves by a predetermined degree with respect to the brackets 50 or the tension bar 32. Although specifically described later, free movement of the floating bar 35 levels a tension on the medium 5 in the lateral direction. Consequently, floating of the medium 5 from the platen 11 is reduced or prevented.

In this preferred embodiment, gaps are preferably provided in both a space between the inner hole 63 of the bush 60 and the center axis member 35*a* and a space between the cylindrical portion 61 of the bush 60 and the insertion hole 51*a* of the bracket 50, but a gap may be provided in only one of these spaces.

The extending portions 53 are provided with the cushioning members 53*a*. The cushioning members 53*a* are attached to portions of the extending portions 53 that face the apron 12 and are to contact the apron 12. The cushioning members 53*a* are made of, for example, rubber. Each of the cushioning member 53*a* has a pad shape. When the brackets 50 and the floating bar 35 swing toward the medium 5, the brackets 50 might contact the apron 12. The cushioning members 53*a* are used to reduce an impact occurring when the brackets 50 contact the apron 12.

As illustrated in FIG. 3, the restricting portions 54 are disposed downstream of the body portions 51 in the conveyance directions X. Each of the restricting portions 54 is provided in a portion of the bracket 50 located at an outer side of the tension bar 32 relative to the body portion 51 when seen from an end of the tension bar 32 (e.g., in the right side view) and downstream of the floating bar 35 in the conveyance directions X. The restricting portions 54 can contact the stoppers 45. The restricting portions 54 are located closer to the center axis member 32*a* than the projecting portions 52 in the radial direction of the tension bar 32. The restricting portions 54 project toward the stoppers 45 relative to the projecting portions 52. The stoppers 45 are disposed in rotation orbits of the restricting portions 54 at positions outside the tension bar 32 when seen from an end of the tension bar 32.

The projecting portions 52 define and function as operation portions to be used to cause the floating bar 35 to swing. The projecting portions 52 are disposed radially outside not to overlap with the tension bar 32 and downstream of the floating bar 35 in the conveyance directions X, when seen in the rotation axis of the tension bar 32. The projecting portions 52 are located at the opposite side to the extending portions 53 with respect to the floating bar 35. The projecting portions 52 extend in parallel with the rotation axis of the tension bar 32. The projecting portions 52 extend toward the floating bar 35 from the body portions 51. The projecting portions 52 are formed by bending portions of metal plates defining the brackets 50 toward the floating bar 35. A predetermined gap is provided between each projecting portion 52 and the floating bar 35. The predetermined gap is large enough to allow an operator to insert his/her finger.

As described above, when the floating bar 35 and the brackets 50 are caused to swing toward the medium 5 to place the floating bar 35 on the medium 5, the floating bar 35 is located between the tension bar 32 and the platen 11. As illustrated in FIG. 1, the upper end of the floating bar 35 is located below the upper end of the tension bar 32 and below the upper surface of the platen 11. In this manner, in the state where the floating bar 35 swings toward the medium 5, the projecting portions 52 are located above the platen 11.

The operator puts his/her fingers on the projecting portions 52 to move the floating bar 35 and the brackets 50 so that the floating bar 35 and the brackets 50 can be caused to swing in a direction away from the medium 5 placed on the platen 11 and the apron 12. In addition, the operator puts his/her fingers on the projecting portions 52 to move the floating bar 35 and the brackets 50 to cause the floating bar 35 and the brackets 50 to swing toward the medium 5. Since the brackets 50 include the projecting portions 52 as described above, the floating bar 35 can be caused to swing smoothly. The extending portions 53 or the projecting portions 52 may be disposed at the opposite side to the floating bar 35 with respect to the body portions 51.

In the case of printing with the printer 10 according to this preferred embodiment, as indicated by chain double-dashed lines in FIG. 5, the operator puts his/her fingers on the projecting portions 52 of the brackets 50 to raise the floating bar 35 and the brackets 50 toward the front so that the floating bar 35 moves away from the platen 11. Thereafter, the restricting portions 54 of the brackets 50 are brought into contact with the stoppers 45 of the support members 41. In this state, the front end portion of the sheet medium 5 drawn onto the platen 11 is caused to pass between the tension bar 32 and the floating bar 35. In addition, as illustrated in FIG. 3, the medium 5 is wound around the outer peripheral surface of the movable tension bar 33 and is wound onto the outer peripheral surface of the winding bar 31.

Thereafter, the operator puts his/her fingers on the projecting portions 52 of the brackets 50 to pull down the brackets 50 rearward (toward the platen 11 in this preferred embodiment). Then, the brackets 50 are rotated down toward the platen 11 so that the floating bar 35 is brought into contact with the upper surface of the medium 5 as illustrated in FIG. 5. At this time, the floating bar 35 pushes the medium 5 downward due to the weight of the floating bar 35. At this time, if the brackets 50 excessively approach the apron 12, the cushioning members 53*a* on the extending portions 53 contact the apron 12 and absorb an impact. In this state, when the movable tension bar 33 applies a tension to the medium 5, the brackets 50 are separated from the platen 11 and the apron 12. At this time, the floating bar 35 is placed on the medium 5 while being scooped upward by the medium 5, and pushes the medium 5 downward while contacting the medium 5 due to the weight of the floating bar 35. In this state, in conveying the medium 5 in the conveyance directions X, the floating bar 35 rotates.

As described above, in this preferred embodiment, the printer 10 includes the platen 11 that supports the medium 5, the conveyance mechanism 20 that conveys the medium 5 supported by the platen 11 from the upstream side toward the downstream side in the conveyance directions X, the tension bar 32, and the floating bar 35, as illustrated in FIG. 1. The tension bar 32 is disposed downstream of the platen 11 in the conveyance directions X, and the lower surface of the medium 5 conveyed from the platen 11 to the downstream side in the conveyance directions X contacts the tension bar 32. The floating bar 35 is disposed downstream of the platen 11 in the conveyance directions X and upstream of the tension bar 32 in the conveyance directions X, and contacts the upper surface of the medium 5 located between the platen 11 and the tension bar 32. The center axis of the floating bar 35 is freely movable by a predetermined degree. In this preferred embodiment, the conveyance mechanism 20 includes the driving rollers 21 and the pinching rollers 22 that at least vertically sandwich both ends of the medium 5 in the direction (the scanning directions Y in this preferred embodiment) intersecting the conveyance directions X in plan view.

In this manner, the floating bar 35 comes to be situated on the medium 5 located between the platen 11 and the tension bar 32. At this time, the floating bar 35 is allowed to push the medium 5 downward while freely moving, in accordance with a tension occurring in the medium 5. Accordingly, the medium 5 can be remain stretched by the floating bar 35, and thus, floating of the medium 5 from the platen 11 can be reduced or prevented.

Specifically, in this preferred embodiment, the floating bar 35 is brought into contact with the medium 5 floating between the platen 11 and the tension bar 32 while the floating bar 35 is placed on the medium 5 due to the weight of the floating bar 35. At this time, the medium 5 is pushed down, and the center axis C35 of the floating bar 35 freely moves by a predetermined degree. In this preferred embodiment, the movable tension bar 33 applies a tension to the medium 5.

In this preferred embodiment, in a case where parallelism between the tension bar 32 and the driving roller 21 is extremely high, the tension on the medium 5 is substantially uniform in the lateral direction. On the other hand, in a case where parallelism between the tension bar 32 and the driving roller 21 is not high, the tension on the medium 5 varies in the lateral direction. Parallelism between the tension bar 32 and the driving roller 21 is supposed to vary depending on the temperature. Elongation of the medium 5 is supposed to vary depending on the humidity. For this reason, even in a case where parallelism between the tension bar 32 and the driving roller 21 is simply increased, it is difficult to make uniform the tension on the medium 5 in the lateral direction. This variation in tension on the medium 5 in the lateral direction causes the elongation degree of the medium 5 in the conveyance directions X to vary so that the medium 5 warps. Consequently, the platen 11 easily floats. Floating of the medium 5 from the platen 11 is more conspicuous as the medium 5 becomes thinner (i.e., the medium 5 is more easily elongated). In addition, in a case where the driving rollers 21 and the pinching rollers 22 sandwich only both lateral ends of the medium 5, floating of the medium 5 tends to occur easily.

On the other hand, as described in this preferred embodiment, when the floating bar 35 whose center axis C35 is freely movable is placed on the upper surface of the medium 5 floating between the platen 11 and the tension bar 32 as a result of the weight of the floating bar 35, the medium 5 does not significantly warp in a portion of the medium 5 subjected to a large tension, whereas the medium 5 significantly warps in a portion of the medium 5 subjected to a small tension. Accordingly, variations in elongation degree of the medium 5 in the lateral direction are absorbed, and the tension on the medium 5 is levelled in the lateral direction. Thus, floating of the medium 5 from the platen 11 can be reduced or prevented. Since floating of the medium 5 is reduced or prevented, printing quality can be obtained.

As described above, in this preferred embodiment, in the state where a tension is applied by the movable tension bar 33 to the medium 5, the floating bar 35 rotates while applying tension to the upper surface of the medium 5 floating between the platen 11 and the tension bar 32 due to the weight of the floating bar 35 (predetermined weight in this preferred embodiment). At this time, the center axis C35 freely moves in the floating bar 35. A tension to be applied to the medium 5 by the movable tension bar 33 varies in the lateral direction of the medium 5 as long as the tension bar 32 and the driving rollers 21 are not parallel. In addition, as the medium 5 becomes thinner or is more easily elongated, the elongation degree in the conveyance directions X is more likely to vary in the lateral direction. Such a difference in elongation degree of the medium 5 can cause floating of the medium 5 from the platen 11.

On the other hand, as described in this preferred embodiment, when the floating bar 35 that is freely movable applies tension to the medium 5 floating between the platen 11 and the tension bar 32 due to the weight of the floating bar 35, the floating bar 35 pushes the medium 5 downward while freely moving, in accordance with a balance of a tension on the medium 5. Accordingly, a difference in elongation degree of the medium 5 in the conveyance directions X is absorbed so that a balance of tension on the medium 5 is levelled in the lateral direction. As a result, floating of the medium 5 from the platen 11 is reduced or prevented.

In this preferred embodiment, as illustrated in FIG. 3, the printer 10 includes the brackets 50 disposed at ends (both ends in the scanning directions Y in this preferred embodiment) of the tension bar 32 and capable of rotating about the tension bar 32 in the circumferential direction of the tension bar 32. The floating bar 35 is provided on the brackets 50. In this preferred embodiment, since the floating bar 35 is provided on the brackets 50 rotatable in the circumferential direction of the tension bar 32, the floating bar 35 is movable in directions toward and away from the platen 11. The floating bar 35 can be disposed toward the platen 11 so that tension balance of the medium 5 can be levelled. In addition, the floating bar 35 is caused to move away from the platen 11 by rotating the brackets 50 so that winding of the medium 5 can be easily performed.

In this preferred embodiment, the floating bar 35 includes the center axis member 35*a* projecting from the floating bar 35 in the axial direction (the scanning directions Y in this preferred embodiment). The center axis member 35*a* is freely fitted into the brackets 50 to be freely movable with respect to the brackets 50. Accordingly, the floating bar 35 is freely movable with a simple configuration so that tension balance of the medium 5 can be levelled.

In this preferred embodiment, the brackets 50 include the body portions 51 supported by the tension bar 32, and the restricting portions 54 provided in portions of the brackets 50 located at outer sides of the tension bar 32 relative to the body portions 51 when seen from an end of the tension bar 32 and downstream of the floating bar 35 in the conveyance directions X. The printer 10 includes the stoppers 45 disposed in rotation orbits of the restricting portions 54 at positions outside the tension bar 32 when seen from an end of the tension bar 32. The stoppers 45 are configured to contact the restricting portions 54 when the floating bar 35 and the brackets 50 rotate about the tension bar 32 and move in a direction away from the platen 11. Accordingly, even in a case where the brackets 50 and the floating bar 35 swing excessively, the contact of the restricting portions 54 with the stoppers 45 can restrict movement of the brackets 50 and the floating bar 35. The stoppers 45 are provided on the support members 41 in this preferred embodiment, but may be disposed at any location. For example, the stoppers 45 may be provided on portions of the printer 10, such as on the side frames 16.

In this preferred embodiment, as illustrated in FIG. 1, the printer 10 includes the apron 12 disposed downstream of the platen 11 in the conveyance directions X. As illustrated in FIG. 5, the brackets 50 include the extending portions 53 provided in portions of the brackets 50 located at outer sides of the tension bar 32 relative to the body portions 51 when seen from an end of the tension bar 32 and upstream of the floating bar 35 in the conveyance directions X. The extending portions 53 face the apron 12 when the floating bar 35 and the brackets 50 rotate about the tension bar 32 and move toward the platen 11. The brackets 50 include the cushioning members 53*a* provided on the surfaces of the extending portions 53 facing the apron 12 and capable of contacting the apron 12. Accordingly, in placing the floating bar 35 on the upper surface of the medium 5, direct contact between the apron 12 and the brackets 50 is prevented so that the cushioning members 53*a* can absorb an impact.

The printer 10 according to this preferred embodiment has been described above. The present teaching is not limited to the preferred embodiments disclosed herein, and various changes and modifications may be made within the gist of the present teaching. For example, in the preferred embodiments described above, the floating bar 35 rotates while being put on and contacting the upper surface of the medium 5 floating between the platen 11 and the tension bar 32. Alternatively, a biasing mechanism with which the floating bar 35 is pushed against the medium 5 may be provided. The biasing mechanism is capable of adjusting a weight under which the floating bar 35 pushes the medium 5 downward.

In the preferred embodiments described above, the restricting portions 54 of the brackets 50 are provided closer to the tension bar 32 than the projecting portions 52 in the radial direction of the tension bar 32, and project toward the stoppers 45 relative to the projecting portions 52. Alternatively, the restricting portions 54 may be disposed inside the projecting portions 52 as long as the restricting portions 54 are provided at the downstream side in the conveyance directions X. Alternatively, the projecting portions 52 may be used as the restricting portions 54, namely, the projecting portions 52 may contact the stoppers 45. In this case, the projecting portions 52 have both the operation function and the restriction function. As a result, the shape of the brackets 50 can be simplified.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

a platen to support a medium;

a conveyor to convey the medium supported by the platen from an upstream side toward a downstream side in conveyance directions;

a tension bar downstream of the platen in the conveyance directions and positioned such that a lower surface of the medium conveyed from the platen to the downstream side in the conveyance directions contacts the tension bar;

a bracket supported by an end portion of the tension bar and rotatable about the tension bar in a circumferential direction of the tension bar;

a floating bar downstream of the platen in the conveyance directions and upstream of the tension bar in the conveyance directions and positioned such that an upper surface of the medium located between the platen and the tension bar contacts the floating bar, the floating bar having a center axis that is movable by a predetermined degree; and an apron downstream of the platen in the conveyance directions, wherein the floating bar is disposed on the bracket;

the bracket includes:

a body portion supported by the tension bar;

an extending portion provided in a portion of the bracket located at an outer side of the tension bar relative to the body portion when seen from an end of the tension bar and upstream of the floating bar in the conveyance directions, the extending portion facing the apron when the floating bar and the bracket rotate about the tension bar and move toward the platen; and a cushion on a surface of the extending portion facing the apron to contact the apron.

2. The ink jet printer according to claim 1, wherein the conveyor includes driving rollers and pinching rollers to at least vertically sandwich end portions of the medium in a direction intersecting the conveyance directions.

3. An ink jet printer comprising:

a side frame;

a platen to support a medium;

a conveyor to convey the medium supported by the platen from an upstream side toward a downstream side in conveyance directions;

a tension bar downstream of the platen in the conveyance directions and positioned such that a lower surface of the medium conveyed from the platen to the downstream side in the conveyance directions contacts the tension bar;

a bracket supported by an end portion of the tension bar and rotatable about the tension bar in a circumferential direction of the tension bar; and a floating bar downstream of the platen in the conveyance directions and upstream of the tension bar in the conveyance directions and positioned such that an upper surface of the medium located between the platen and the tension bar contacts the floating bar, the floating bar having a center axis that is movable by a predetermined degree, wherein the platen is supported by the side frame;

the tension bar includes a center axis member projecting from the tension bar in an axial direction and the center axis member is rotatably supported on the side frame;

the bracket is supported to be swingable about the center axis member of the tension bar; and the floating bar is disposed on the bracket.

4. An ink jet printer comprising:

a platen to support a medium;

a conveyor to convey the medium supported by the platen from an upstream side toward a downstream side in conveyance directions;

a tension bar downstream of the platen in the conveyance directions and positioned such that a lower surface of the medium conveyed from the platen to the downstream side in the conveyance directions contacts the tension bar;

a bracket supported by an end portion of the tension bar and rotatable about the tension bar in a circumferential direction of the tension bar; and a floating bar downstream of the platen in the conveyance directions and upstream of the tension bar in the conveyance directions and positioned such that an upper surface of the medium located between the platen and the tension bar contacts the floating bar, the floating bar having a center axis that is movable by a predetermined degree, wherein the floating bar is disposed on the bracket;

the floating bar includes a center axis portion projecting from the floating bar in an axial direction;

the center axis portion is rotatably inserted into an insertion hole extended through the bracket via a bush; and a gap is located between at least one of: (i) the bush and the center axis portion of the floating bar, or (ii) the bush and the insertion hole.

5. The ink jet printer according to claim 1, wherein the bracket includes:

a restricting portion provided in a portion of the bracket located at an outer side of the tension bar relative to the body portion when seen from an end of the tension bar and downstream of the floating bar in the conveyance directions;

the ink jet printer further comprises a stopper in a rotation orbit of the restricting portion at a position outside the tension bar when seen from an end of the tension bar; and the restricting portion is positioned to contact the stopper when the floating bar and the bracket rotate about the tension bar and move away from the platen.

6. The ink jet printer according to claim 1, wherein the floating bar includes a center axis portion projecting from the floating bar in an axial direction; and the center axis portion is fitted onto the bracket to be movable with respect to the bracket.

* * * * *